US008929581B2

(12) United States Patent
Kost

(10) Patent No.: US 8,929,581 B2
(45) Date of Patent: Jan. 6, 2015

(54) HEADPHONE APPARATUS WITH A WRITING SURFACE

(71) Applicant: Kevin Kost, Maplewood, NJ (US)

(72) Inventor: Kevin Kost, Maplewood, NJ (US)

(73) Assignee: Zeikos Inc., Edison, NJ (US)

( * ) Notice: Subject to any disclaimer, the term of this patent is extended or adjusted under 35 U.S.C. 154(b) by 0 days.

(21) Appl. No.: 13/828,459

(22) Filed: Mar. 14, 2013

(65) Prior Publication Data

US 2013/0279733 A1 Oct. 24, 2013

Related U.S. Application Data

(60) Provisional application No. 61/635,027, filed on Apr. 18, 2012.

(51) Int. Cl.
*H04R 1/10* (2006.01)

(52) U.S. Cl.
CPC ..... *H04R 1/1091* (2013.01); *H04R 1/1066* (2013.01); *H04R 2420/07* (2013.01)
USPC ..... 381/374; 381/370; 381/371; 381/378

(58) Field of Classification Search
CPC ..... H04R 1/008; H04R 5/033; H04R 5/0335; H04R 1/1066; H04R 1/1058; H04R 1/1016; H04R 1/1083; H04R 1/105; H04R 2201/023; H04R 1/28; H04M 1/05; H04M 1/0258; G09B 21/009; A63F 3/04; A63F 3/0695; A63F 2009/0641; A63F 2009/065; B43L 13/00; B43L 21/00
USPC ..... 381/370–379
See application file for complete search history.

(56) References Cited

U.S. PATENT DOCUMENTS

| | | | | |
|---|---|---|---|---|
| 2006/0193487 | A1* | 8/2006 | Mok et al. | 381/370 |
| 2009/0114144 | A1* | 5/2009 | Keefe | 116/234 |
| 2011/0086335 | A1* | 4/2011 | Rogers | 434/408 |

OTHER PUBLICATIONS

Guy, Nick; Griffin at 2012 CES: Crayola Gear, iOS Music Tools + More; Jan. 8, 2012; iLounge.com; Retrieved from the Internet: http://www.ilounge.com/index.php/news/comments/griffin-at-2012-ces-kids-accessories-ios-music-tools-more/.*

Horwitz, Jeremy; Griffin Crayola MyPhones + MyPhones Earbuds; Apr. 30, 2012; iLounge.com; Retrieved from the internet: http://www.ilounge.com/index.php/reviews/entry/griffin-crayola-myphones-myphones-earbuds/.*

* cited by examiner

*Primary Examiner* — Ahmad F. Matar
*Assistant Examiner* — Sabrina Diaz
(74) *Attorney, Agent, or Firm* — Amster, Rothstein & Ebenstein, LLP

(57) ABSTRACT

A headphone apparatus is provided that may include a headphone and a writing surface. The headphone may include a headband, supports, and earpieces. The writing surface may be attached to a portion of the headphone. The writing surface may comprise a surface adapted to be written and erased on repeatedly, such as a dry-erase panel. The headphone apparatus may also include an eraser, which may be adapted to substantially and repeatedly erase what is written on the writing surface. The eraser may be slidably attached to at least a portion of the writing surface. Alternatively, the eraser may be attached to a portion of the headphone and/or the writing surface removably and/or via a flexible material. The headphone apparatus may further include a writing apparatus, which may be attached to a portion of the headphone apparatus and/or the writing surface removably and/or via a flexible material.

12 Claims, 4 Drawing Sheets

HEADPHONE APPARATUS WITH A WRITING SURFACE

CROSS-REFERENCE TO RELATED APPLICATIONS

This patent application claims the benefit of U.S. Provisional Patent Application Ser. No. 61/635,027, filed on Apr. 18, 2012, the disclosure of which is hereby incorporated by reference in its entirety.

FIELD

The present disclosure generally relates to headphone apparatus equipped with a surface or surfaces that allow one to write characters or draw figures on and erase them off repeatedly.

SUMMARY

In exemplary embodiments, a headphone apparatus of the present disclosure may contain a headphone and one or more writing surfaces. As its components, the headphone may contain one or more headbands, one or more supports, one or more earpieces, or any combination thereof. The writing surface may be attached to any one or more of these headphone components, and is capable of having, for example, characters written on and erased off repeatedly or figures drawn on and erased off repeatedly. In other exemplary embodiments, a headphone apparatus of the present disclosure may also contain or be accompanied by one or more erasers. The eraser is capable of substantially and repeatedly erasing, for example, a character written or a figure drawn on the writing surface, and may be slidably attached to at least a portion of the writing surface, or may be attached removably or via is flexible material to the writing surface and/or to any of the headphone components. In further exemplary embodiments, a headphone apparatus of the present disclosure may also contain or be accompanied by one or more writing apparatus. The writing apparatus allows one, for example, to write a character or draw a figure repeatedly on the writing surface, which character or figure can be substantially and repeatedly erased by the eraser. The writing apparatus may be attached removably or via a flexible material to the writing surface and/or to any of the headphone components.

BRIEF DESCRIPTION OF THE DRAWINGS

The features and advantages of the present disclosure will be more fully understood with reference to the following, detailed description when taken in conjunction with the accompanying figures, wherein.

Figure 1:
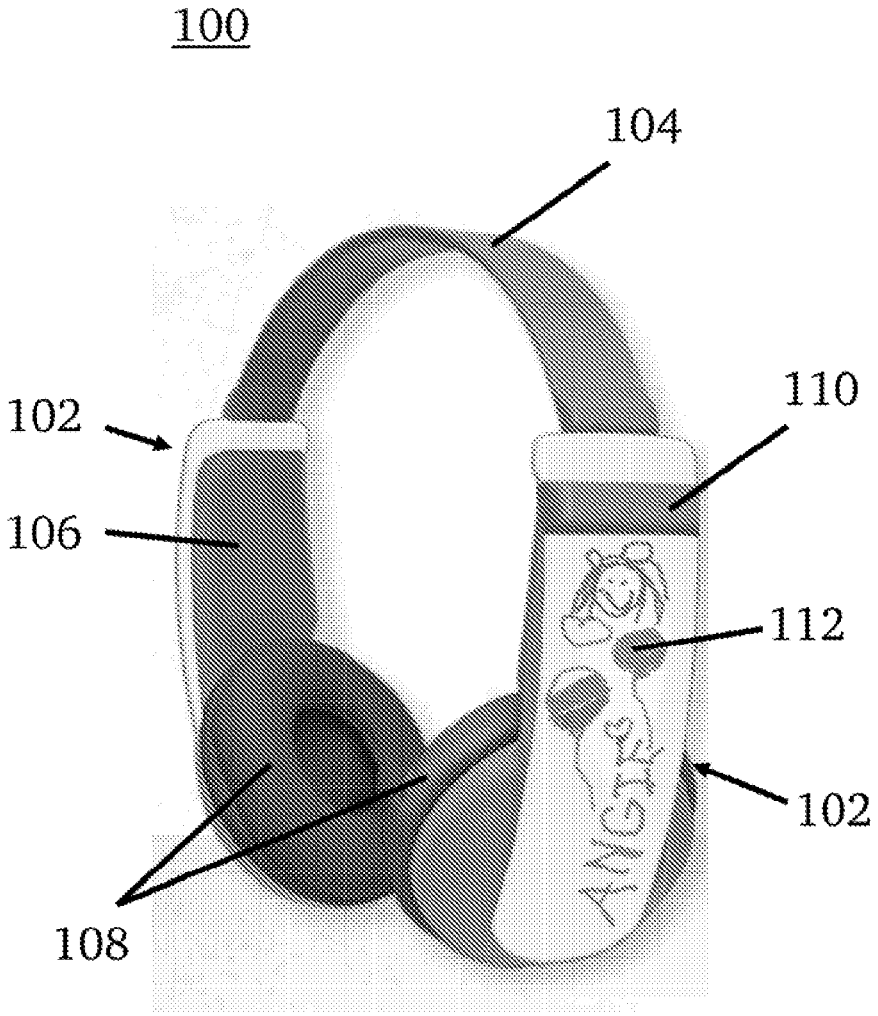
FIG. 1 is a perspective view of a headphone apparatus in accordance with exemplary embodiments of the present disclosure.

The headings used herein are for organizational purposes only and are not ant to be used to limit the scope of the description. As used throughout this application, the words "may" and "can" are used in a permissive sense (i.e., meaning having the potential to), rather than the mandatory sense (i.e., meaning must). Similarly, the words "include," "including," and "includes" can mean including but not limited to. To facilitate understanding, like reference numerals have been used, were possible, to designate like elements common to the figures.

DETAILED DESCRIPTION

Figure 2:
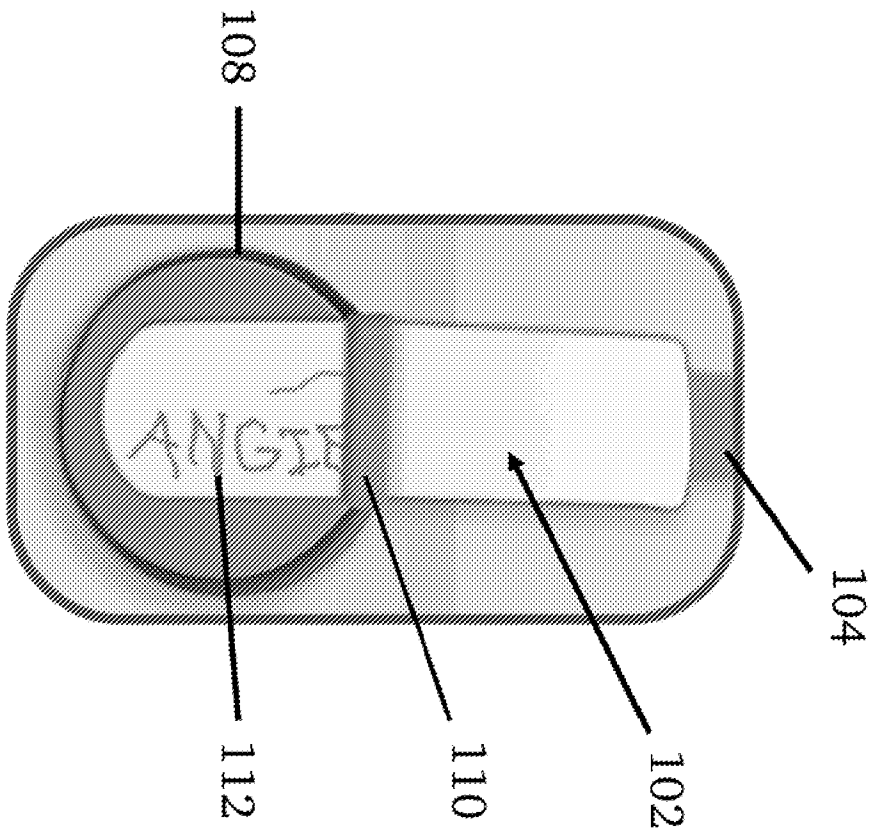
FIG. 2 is a side view of a headphone apparatus in use in accordance with exemplary embodiments of the present disclosure.
Figure 3:
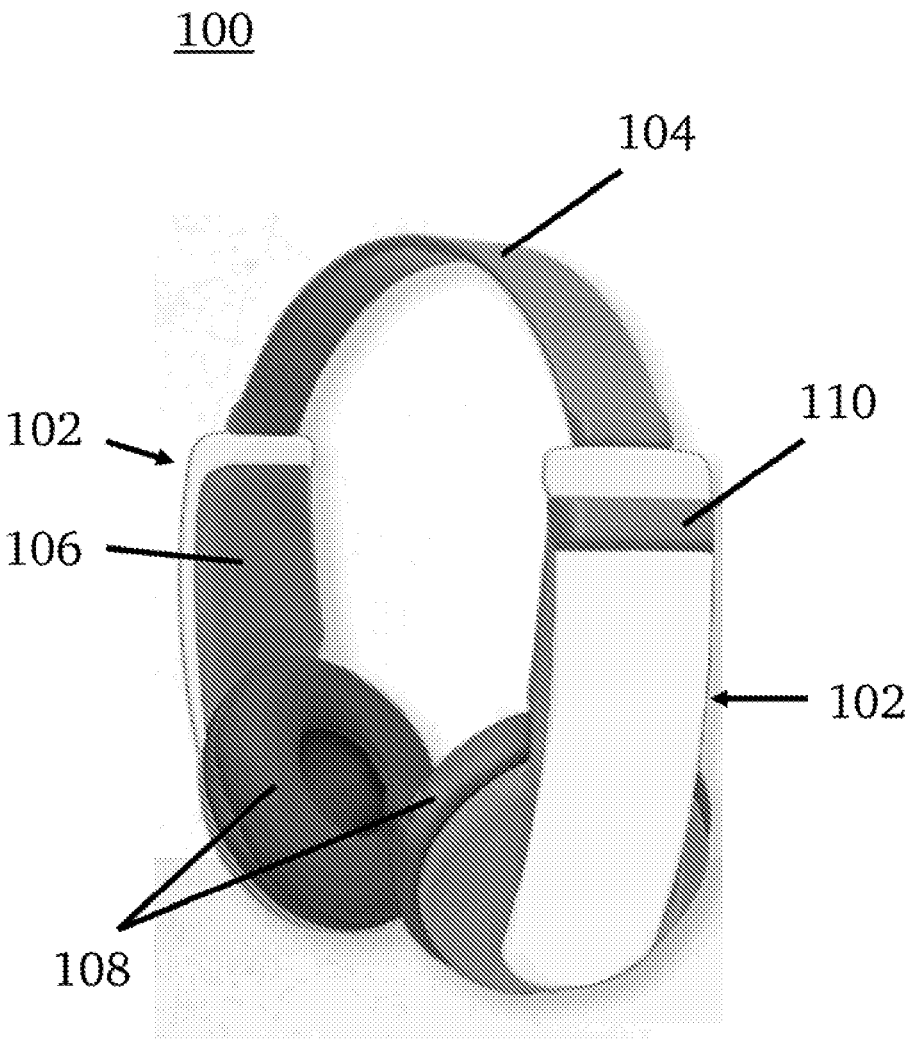
FIG. 3 is a perspective view of a headphone apparatus in accordance with exemplary embodiments of the present disclosure.

The following detailed description generally describes various exemplary embodiments of the present disclosure, as depicted in FIGS. 1-3, and should not be considered limiting to other equally effective embodiments, as understood to those of ordinary skill in the art.

In the following detailed description, numerous specific details are set forth in order to provide a thorough understanding of embodiments or other examples described herein. In some instances, well-known methods, procedures, and components have not been described in detail, so as to not obscure the following description. Further, the examples disclosed are for exemplary purposes only and other examples may be employed in lieu of, or in combination with, the examples disclosed.

FIG. 1 is a perspective view of a headphone apparatus 100 in accordance with exemplary embodiments of the present disclosure. The headphone apparatus 100 may comprise a headband 104, one or more writing surfaces 102, one or more supports 106, and one or more earpieces 108. The headphone apparatus 100 may further comprise one or more erasers 110.

The headband 104 may be adapted to partially encircle and/or conform to the head of a user. The headband 104 may also be adapted to fit on various positions on the user's head. For example, the headband may be adapted to fit on the top of the user's head or behind the user's head, to name a few positions. The headband 104 may he adapted to support one or more earpieces 108 on a user's head. The headband 104 may comprise a substantially flexible material adapted to allow the headphones to fit on various-sized heads. For example, the headband 104 may comprise plastic, polyether, polyester, or any other suitable material. In alternative embodiments, the headband 104 may not be included.

The headband 104 may be attached to one or more writing surfaces 102, to one or more supports 106, to one or more earpieces 108, or to any combination thereof. The attachment may be detachable to allow any of the headband 104, the one or more writing surfaces 102, the one or more supports 106, and the one or more earpieces 108 to be replaced and/or cleaned. For example, the attachment may involve a hook-and-loop-type fastener such as a Velcro® product, a dip-on or snap-on structure, a reversible adhesive, a magnet, or any other suitable mechanism.

The headband 104 may also comprise a cushioning layer (not shown) on the inside surface of the headband 104 for providing comfort to the user. For example, the cushioning layer may comprise polyurethane, polyester, wool, feathers, non-woven material, or any other suitable material. The cushioning layer may be integral with the headband 104 or it may be a separate layer attached to the headband 104. The cushioning layer may comprise a number of cushions. For example the cushioning layer may comprise one, two, or three cushions, to name a few. The cushioning layer may also be detachably attached to the headband to allow the cushioning layer to be replaced and/or cleaned. For example, the attachment may involve a hook-and-loop-type fastener such as a Velcro® product, a clip-on or snap-on structure, a reversible adhesive, a magnet, or any other suitable mechanism.

The one or more supports 106 may comprise a material adapted to support a pair of earpieces 108. For example, the one or more supports 106 may comprise plastic such as polystyrene or polyvinyl chloride, or the support may comprise any other suitable material.

The earpieces 108 may comprise one or more speakers, one or more microphones, one or more antennas, or any combination thereof. The earpieces 108 may also comprise one or more padded sections for providing comfort to the user. For example, the padded sections may comprise polyurethane, polyester, or any other suitable material. The padded sections may be integral with the earpieces 108. Alternatively, they may be detachably attached to the earpieces 108 to allow the padded sections to be replaced and/or cleaned. For example, the attachment may involve a hook-and-loop-type fastener such as a Velcro® product, a clip-on or snap-on structure, a reversible adhesive, a magnet, or any other suitable mechanism.

The earpieces 108 may be attached to the one or more supports 106, to the headband 104, to the one or more writing surfaces 102, or to any combination thereof. The attachment may be detachable to allow the one or more earpieces 108, the one or more supports 106, the headband 104, and/or the one or more writing surfaces 102 to be replaced and/or cleaned, For example, the attachment may involve a hook-and-loop-type fastener such as a Velcro® product, a clip-on or snap-on structure, a reversible adhesive, a magnet, or any other suitable mechanism.

The speakers in the earpieces 108 may be adapted to communicatively couple with an and signal and produce a sound. The microphone in the earpieces 108 may be adapted to receive a sound and communicatively transmit an audio signal. The speakers may receive the audio signal via a wired or wireless connection. independently of the speakers, the microphone may transmit, the audio signal via a wired or wireless connection. When there is a wired connection to the one or more earpieces 108, the microphone may be situated on the connecting wire instead of or in addition to the earpieces 108.

The one or more writing surfaces 102 may be attached to a portion of the one or more supports 106, to a portion of the headband 104, to a portion of the one or more earpieces 108, or to any combination thereof. The wilting surface 102 may be of any suitable topography. For example, it may be substantially fiat, curved, or saddle-like, and it may also contain steps. The writing surface 102 may be of any suitable shape. For example, it may be substantially round, oval, triangular, square, rectangular, polygonal, concavely shaped, star-shaped, or animal-shaped. The writing surface 102 may be of any suitable size. For example, it may be approximately the size of a hand of an average adult, an average child, or an average toddler. The writing surface 102 may be contiguous, or it may have holes of any suitable sizes and shapes in any suitable positions, and it may also be divided into two or more sections of any suitable sizes, shapes, and topographies.

The writing surfaces 102 may be adapted to receive marks or writing 112, and may comprise any suitable material that allows one to write characters or draw figures on and erase them off repeatedly. By way of example, the writing surfaces 102 may comprise a dry erase surface adapted to receive writing 112 or marks from dry erase markers. By way of additional example, the wilting surfaces 102 may comprise a chalkboard or a blackboard adapted to receive writing 112 or marks from pieces of chalk. By way of further example, the writing surfaces 102 may comprise a hard, glossy non-porous surface adapted to receive writing 112 or marks from grease pencils.

Although two writing surfaces 102 are depicted in FIG. 1, a different number of writing surfaces 102 may be included. For example, the headphone apparatus 100 may comprise one, three, five, or ten writing surfaces 102, to name a few. Further, other types of headphone apparatus 100 including writing surfaces 102 are contemplated by, and within the present disclosure.

The writing surfaces 102 may form an integral part of the headphone apparatus 100. Alternatively, the writing surfaces 102 may be removably attached. For example, they may be removably attached to a portion of the headphone apparatus 100 by a hook-and-loop-type fastener such as a Velcro® product, a clip-on or snap-on structure, a reversible adhesive, or a magnet, or by any other suitable mechanism. Additional portions of the headphone apparatus 100 may comprise a writing surface 102. For example, the headband 104 and/or supports 106 may comprise a writing surface 102. Alternatively, when a headband 104 and/or supports 106 are not included, at least a portion of the earpieces 108 may comprise a writing surface 102. The headphone apparatus 100 may be packaged with or without writing means or apparatus, for example, dry erase markers, pieces of chalk, or grease pencils.

In exemplary embodiments, the writing surface 102 may comprise a dry erase surface comprising a substantially rigid surface such as fiberboard or metal having a surface coated with smooth, hard material such as enamel, melamine resin, polyethylene terephthalate, or any other suitable material. The coating of the writing surface 102 may operate to receive and releasably retain the writing 112. The writing may be made with a writing apparatus 150 (See FIG. 4) that may produce an erasable writing 112. By way of example, the writing apparatus 150 may comprise dry-erase markers. The writing 112 may comprise erasable material, such as a solvent-based ink (e.g., based on 1-propanol, 1-butanol, diacetone alcohol, or cresols), wherein the ink can be removed from the surface by wiping with the eraser 110.

In exemplary embodiments, the writing surface 102 may comprise a chalkboard or a blackboard. A chalkboard or a blackboard, for example, may comprise a substantially rigid material such as steel or slate stone having a surface coated with porcelain, matte paint, or any other suitable material. The coating of the writing surface 102 may operate to receive and releasably retain the erasable writing 112 made with a suitable writing apparatus. By way of example, the writing apparatus may comprise a piece of chalk. The writing 112 may comprise erasable material, such as calcium carbonate, calcium sulfate, or any other suitable material, wherein the material can be removed from the surface by wiping with the eraser 110.

In exemplary embodiments, the writing surface 102 may comprise a hard, glossy non-porous surface such as porcelain, glass, polished stone, plastic, ceramics, or any other suitable material that is, for example, glazed, lacquered, or polished. The writing surface 102 may operate to receive and releasably retain the erasable writing 112 made with a suitable writing apparatus. By way of example, the writing apparatus may comprise a grease pencil or a china marker. The writing 112 may comprise erasable material, such as wax or any other suitable material, wherein the material can be removed from the surface by wiping with the eraser 110.

in exemplary embodiments, the eraser 110 may comprise a backing portion and an erasing portion. The erasing portion may be adapted to erase the writing 112. By way of example, the erasing portion may comprise a soft-pile material, sponge, cloth, a felt pad, and/or an absorbent textile, to name a few. The backing portion may comprise a substantially rigid material adapted to be held or moved by a user, thereby allowing the user to move the eraser 110 across the writing surface 102. The erasing portion and the backing portion may be integral with each other. Alternatively, they may be detachably attached to each other to allow one or both of them to be replaced and/or cleaned. For example, the attachment may involve a hook-and-loop-type fastener such as a Velcro® product, a clip-on or snap-on structure, a reversible adhesive, a magnet, or any other suitable mechanism.

The eraser 110 may be of any suitable shape. For example, it may be substantially spherical, tetrahedral, cubic, octahedral, concavely shaped, football-shaped, or animal-shaped. The eraser 110 may also be of any suitable size. For example, it may be approximately the size of a fist of an average adult, an average child, or an average toddler.

The eraser 110 may be attached to and/or integral with a portion of the headphone apparatus 100. For example, the eraser 110 may be attached to the one or more writing surfaces 102, the headband 104, the one or more supports 106, the one or more earpieces 108, or any combination thereof. By way of example, the eraser 110 may he slidably attached to the sides of the writing surface 102. Alternatively, the eraser 110 may be removably attached to a portion of the headphone apparatus 100 so that it may be removed and used whenever needed. For example, the removable attachment may involve a hook-and-loop-type fastener such as a Velcro® product, a clip-on or snap-on structure, a reversible adhesive, a magnet, or any other suitable mechanism. Or the eraser 110 may be attached to a portion of the headphone apparatus 100 via a flexible material such as a string, a coil, or any other suitable material. The eraser 110 may also be attached to a portion of the headphone apparatus 100 both removably and via a flexible material. In alternative embodiments, the eraser 110 may be free standing or the headphone apparatus 100 may not include an eraser 110.

In exemplary embodiments, a user may make a mark or writing 112 on the writing surface 102 of the headphone apparatus 100. The writing 112 may be decorative or may be in the form of text, for example, to indicate the name of the user. The writing 112 may comprise various colors. After the writing 112 is applied to the writing surface 102, the user may decide to erase the writing 112. By way of example, a child may draw a picture, text, or other form of writing 112 on the writing surface 102 and may want to then replace it with a different picture, text, or writing 112. The child may erase the original writing 112 by erasing the writing 112 with the eraser 110 and then drawing a second piece of writing 112. The child may perform these actions repeatedly.

Referring now to FIG. 2, a side view of a headphone apparatus 100 in use in accordance with exemplary embodiments of the present disclosure is shown. In exemplary embodiments, when the user decides to erase the writing 112 on the writing surface 102, the user will move the eraser 110 across the writing surface 102 so that the eraser 110 contacts and substantially erases the writing 112. As shown in FIG. 2, the writing 112 depicted in FIG. 1 has been partially erased. The user may choose to erase a portion of the writing 112 by sliding the eraser 110 down over a portion of the writing surface 102 and returning the eraser 110 to its original position. Alternatively, the user may choose to erase all of the writing 112 by sliding the eraser across the entire writing surface 102.

The eraser 110 may be moved longitudinally over the writing surface 112 in an upward or downward direction. Alternatively, the eraser 110 may be positioned and attached on the writing surface 102 such that the eraser 110 may be slidably moved in other directions across the writing surface 102, for example, sideways. The eraser 110 may also be releasably attached such that it may be removed to be cleaned and/or replaced. In exemplary embodiments, if the writing 112 is not completely erased, the user may again pass the eraser 110 back over the writing surface 102 and return the eraser 110 to the original position. For example, when the eraser 110 is moved in a downward direction in a first pass across the writing surface 102, a second pass across the writing surface 102 may be made in an upward direction. The user may make numerous passes across the writing surface 112 until the user is satisfied that the writing 112 is sufficiently erased.

In exemplary embodiments, the eraser 110 may further comprise elements that may be adapted to automatically return the eraser to a first position after the eraser 110 has been moved to a second position. For example, when the eraser 110 is on the top of the writing surface 102, the eraser may be moved to the bottom of the writing surface 102. The eraser 110 may then automatically return to the top of the writing surface 102 when the user releases the eraser 110. By way of example, springs or any other suitable mechanism may be included to return the eraser 110 hack to the first position.

Referring now to FIG. 3, a perspective view of a headphone apparatus 100 in accordance with exemplary embodiments of the present disclosure without writing 112 is shown. The headphone apparatus 100 may not have writing 112 on the writing surface 102 immediately after the headphone apparatus 100 has been manufactured, or after the completion of an erasing operation as described herein with respect to FIG. 2. In alternative embodiments, the erasing operation may be completed by an eraser removably attached to a portion of the headphone apparatus 100, by an eraser attached to a portion of the headphone apparatus 100 via a flexible material, by an eraser attached to a portion of the headphone apparatus 100 both removably and via a flexible material, or by a free-standing eraser (not shown).

Figure 4:
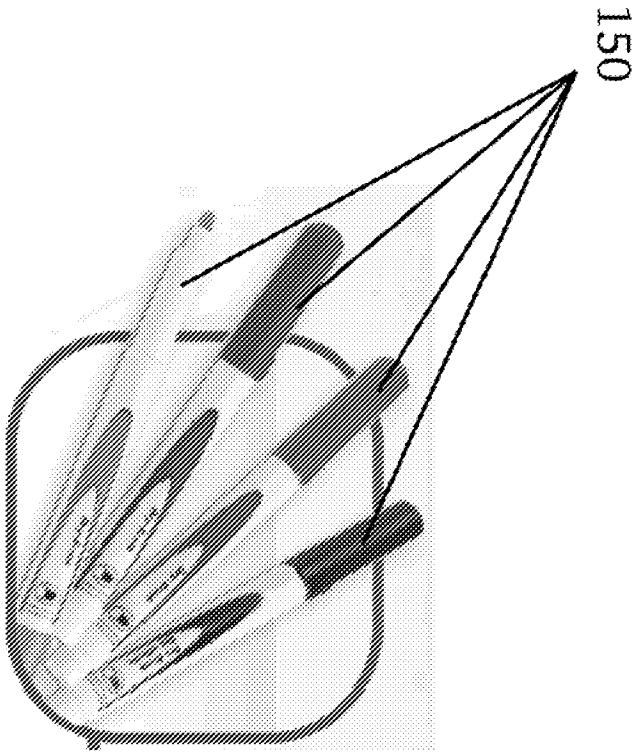
FIG. 4 is a side view of writing apparatus in accordance with exemplary embodiments of the present disclosure.

Referring now to FIG. 4, a side view of writing apparatus 150 in accordance with exemplary embodiments of the present disclosure is shown. The writing apparatus 150 may produce a writing 112 that may be erasable with an eraser 110. By way of example, the writing apparatus 150 may comprise dry-erase pens, pieces of chalk, grease pencils, china markers, or any other suitable writing apparatus. Alternatively, the writing apparatus 150 may comprise stamps or other means adapted to produce erasable writing 112 on a writing surface 102.

In exemplary embodiments, the writing apparatus 150 may be removably attached to the one or more writing surfaces 102, the headband 104, the one or more supports 106, the one or more earpieces 108, or any combination thereof, so that it may be removed and used whenever needed. For example, the removable attachment may involve a hook-and-loop-type fastener such as a Velcro® product, a clip-on or snap-on structure, a reversible adhesive, a magnet, or any other suitable mechanism. Alternatively, the writing apparatus 150 may be attached to a portion of the headphone apparatus 100 via a flexible material such as a string, a coil, or any other suitable material. The writing apparatus 150 may also be attached to a portion of the headphone apparatus 100 both removably and via a flexible material. In alternative embodiments, the writing apparatus 150 may be free standing or the headphone apparatus 100 may not include a writing apparatus 150.

Now that exemplary embodiments of the present disclosure have been shown and described in detail, various modifications and improvements thereon will become readily apparent to those skilled in the art.

It will be understood that one or more of the steps described can be rearranged, separated, and/or combined without deviating from the scope of embodiments of the disclosure. For ease, steps are, at times, presented sequentially. This is merely for ease and is in no way meant to be a limitation.

Further, it will be understood that one or more of the elements and/or exemplary embodiments of the disclosure described can be rearranged, separated, and/or combined without deviating from the scope of the disclosure. For ease, various elements are described, at times, separately. This is merely for ease and is in no way meant to be a limitation.

While the various steps, elements, and/or exemplary embodiments of the disclosure have been outlined above, it is evident that many alternatives, modifications and variations will be apparent to those skilled in the art. The various steps, elements, and/or exemplary embodiments of the disclosure, as set forth above, are intended to be illustrative, not limiting. Various changes can be made without departing from the spirit and scope of the disclosure. Accordingly, the spirit and scope of the present disclosure is to be construed broadly and not limited by the foregoing specification.

No element, act, or instruction used in the description of the present application should be construed as critical or essential to the disclosure unless explicitly described as such. Also, as used herein, the article "a" is intended to include one or more items. Where only one item is intended, the term "one" or similar language is used.

Further, the terms "any of" followed by a listing of a plurality of items and/or a plurality of categories of items, as used herein, are intended to include "any of," "any combination of," "any multiple of," and/or "any combination of multiples of" the items and/or the categories of items, individually or in conjunction with other items and/or other categories of items. In addition, as used herein, the term "set" is intended to include any number of items, including zero. Further, as used herein, the term "number" is intended to include any number, including zero.

What is claimed is:

1. A headphone apparatus comprising:

a headphone comprising a headband and one or more earpieces attached to the headband;

a writing surface attached to at least a portion of the headphone, the writing surface adapted to be written and erased on repeatedly; and an eraser slidably attached to at least a portion of the writing surface and adapted to substantially and repeatedly erase what is written on the writing surface, the eraser comprising elements adapted to automatically return the eraser to a first position after the eraser has been moved to a second position.

2. The headphone apparatus according to claim 1, wherein the earpieces comprise a padded section.

3. The headphone apparatus according to claim 1, wherein the earpieces comprise a speaker.

4. The headphone apparatus according to claim 3, wherein the speaker is adapted to receive an audio signal via a wired connection.

5. The headphone apparatus according to claim 3, wherein the speaker is adapted to receive an audio signal via a wireless connection.

6. The headphone apparatus according to claim 1, wherein the headband comprises a cushioning layer.

7. The headphone apparatus according to claim 1, wherein the writing surface is detachably attached to the at least a portion of the headphone.

8. The headphone apparatus according to claim 1, wherein the eraser comprises an erasing portion and a backing portion.

9. The headphone apparatus according to claim 1, further comprising a writing apparatus, wherein the writing apparatus is adapted to write repeatedly on the writing surface.

10. The headphone apparatus according to claim 9, wherein the writing apparatus is removably attached to at least a portion of the headphone or a portion of the writing surface.

11. The headphone apparatus according to claim 9, wherein the writing apparatus is attached via a flexible material to at least a portion of the headphone or a portion of the writing surface.

12. The headphone apparatus according to claim 11, wherein the writing apparatus is further removably attached to at least another portion of the headphone or another portion of the writing surface.

* * * * *